US008249863B2

(12) United States Patent
Kim

(10) Patent No.: US 8,249,863 B2
(45) Date of Patent: Aug. 21, 2012

(54) METHOD AND APPARATUS FOR ESTIMATING SPECTRAL INFORMATION OF AUDIO SIGNAL

(75) Inventor: Hyun-Soo Kim, Yongin-si (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 1280 days.

(21) Appl. No.: 11/955,483

(22) Filed: Dec. 13, 2007

(65) Prior Publication Data

US 2008/0147383 A1 Jun. 19, 2008

(30) Foreign Application Priority Data

Dec. 13, 2006 (KR) ..... 10-2006-0127120

(51) Int. Cl.
*G10L 11/04* (2006.01)
*G10L 11/06* (2006.01)

(52) U.S. Cl. ..... 704/206; 704/207; 704/208

(58) Field of Classification Search ..... 704/206–208
See application file for complete search history.

(56) References Cited

U.S. PATENT DOCUMENTS

| | | | | |
|---|---|---|---|---|
| 4,850,022 | A * | 7/1989 | Honda et al. | 704/207 |
| 4,985,923 | A * | 1/1991 | Ichikawa et al. | 704/222 |
| 5,630,011 | A * | 5/1997 | Lim et al. | 704/205 |
| 5,684,920 | A * | 11/1997 | Iwakami et al. | 704/203 |
| 5,873,059 | A * | 2/1999 | Iijima et al. | 704/207 |
| 5,909,663 | A * | 6/1999 | Iijima et al. | 704/226 |
| 5,956,671 | A * | 9/1999 | Ittycheriah et al. | 704/203 |
| 5,999,897 | A * | 12/1999 | Yeldener | 704/207 |
| 6,161,089 | A * | 12/2000 | Hardwick | 704/230 |
| 6,205,422 | B1 * | 3/2001 | Gu et al. | 704/233 |
| 6,401,062 | B1 * | 6/2002 | Murashima | 704/223 |
| 6,681,202 | B1 * | 1/2004 | Miet et al. | 704/214 |
| 6,694,292 | B2 * | 2/2004 | Murashima | 704/219 |
| 7,359,522 | B2 * | 4/2008 | Aarts et al. | 381/94.7 |
| 2004/0260540 | A1 * | 12/2004 | Zhang | 704/205 |
| 2005/0286743 | A1 * | 12/2005 | Kurzweil et al. | 382/114 |

FOREIGN PATENT DOCUMENTS

| | | |
|---|---|---|
| JP | 06-149296 | 5/1994 |
| KR | 2005-3814 | 1/2005 |
| KR | 2007-7684 | 7/2007 |
| WO | WO 01/80223 | 10/2001 |

* cited by examiner

*Primary Examiner* — Eric Yen
(74) *Attorney, Agent, or Firm* — Cha & Reiter, LLC

(57) ABSTRACT

An apparatus and method for estimating audio signal spectrum information. The method including the steps of performing a morphological operation on a received audio signal, extracting peaks by using various peak extraction methods and extracting a remainder signal region from the extracted peaks, selecting a high-order peaks spectrum from the extracted remainder signal region. In addition, spectral envelopes are detected by performing an interpolation operation on the high-order peaks spectrum.

38 Claims, 12 Drawing Sheets

METHOD AND APPARATUS FOR ESTIMATING SPECTRAL INFORMATION OF AUDIO SIGNAL

CLAIM OF PRIORITY

This application claims the benefit of the earlier filing date, under 35 U.S.C. §119(a), to that patent application entitled "Method and Apparatus for Estimating Spectral information of Audio Signal" filed in the Korean Industrial Property Office on Dec. 13, 2006 and assigned Serial No. 2006-0127120, the contents of which are hereby incorporated by reference.

BACKGROUND OF THE INVENTION

1. Field of the Invention

The present invention relates audio signal processing and, more particularly to a method and apparatus for estimating spectral information of an audio or sound signal.

2. Description of the Related Art

In conventional technology, apparatus or algorithms for automatically estimating spectral information of an audio or sound signal in a mobile communication system is limited. For example, according to one method for estimating a spectrum containing a large number of peaks comprises determining a ratio of the total energy of an $n^{th}$ peak in the spectrum to the energy of the $n^{th}$ largest peaks in the spectrum. However, such a method does not take the energy values of small peaks into consideration, and, hence, information of an audio signal is lost.

SUMMARY OF THE INVENTION

The present invention provides an apparatus and method for estimating spectrum information of an audio signal by using a morphological operation. Such an apparatus and a method are suitable for processing and transmitting audio and sound signals through a mobile communication terminal.

The present invention provides a peak extraction method for extracting information of remaining signal characteristic points by using a structuring set size (SSS), a method of selecting an order of a high-order peak, a method of identifying whether or not a spectrum of an audio signal corresponds to a true peaks spectrum by using pitch information, and a method of changing the SSS according to a result of the identification.

Particularly, the peak extraction method includes a hitting peak method, a mid-point method and a pitch-based method, and an enhanced algorithm for the step of selecting an order of a high-order peak is provided. In addition, the present invention provides an algorithm for setting the most suitable SSS.

In accordance with a first aspect of the present invention, there is provided an apparatus for estimating spectrum information of an audio signal, the apparatus including an audio signal input unit for receiving an audio signal, a pitch detector for detecting a pitch of the audio signal received through the audio signal input unit and providing the pitch to a structuring set size (SSS) determiner, a structuring set size(SSS) determiner for determining a period of the pitch as an SSS of the morphology filter and providing the SSS to the morphology; a morphology filter for performing a morphological operation on the audio signal in accordance with a provided SSS; a remainder signal extractor for extracting peaks from the audio signal, which has been subjected to the morphological operation, by using a peak extraction method, extracting a remainder signal region from the extracted peaks, and identifying whether the remainder signal region corresponds to a true-peaks spectrum and a spectral envelope detector for detecting a spectral envelope by performing an interpolation operation on the identified true peaks spectrum.

In accordance with a second aspect of the present invention, there is provided an apparatus for estimating spectrum information of an audio signal, the apparatus including: an audio signal input unit for receiving an audio signal, a pitch detector for detecting a pitch of the audio signal received through the audio signal input unit and providing the pitch to a structuring set size (SSS) determiner, a structuring set size (SSS) determiner for determining a period of the pitch as an SSS of the morphology filter and providing the SSS to the morphology; a morphology filter for performing a morphological operation on the audio signal in accordance with a provided SSS; a high-order peak selector for extracting peaks from the audio signal, which has been subjected to the morphological operation, by using a peak extraction method, extracting a remainder signal region from the extracted peaks, selecting a high-order peaks spectrum from the remainder signal region and identifying whether the high-order peaks spectrum corresponds to a true-peaks spectrum and a spectral envelope detector for detecting a spectral envelope by performing an interpolation operation on the identified true peaks spectrum.

In accordance with a third aspect of the present invention, there is provided a method for estimating spectrum information of an audio signal, using the apparatus for estimating spectrum information of the audio signal based on the first aspect of the present invention, the method including the steps of receiving an audio signal, detecting a pitch of the audio signal; determining a period of the pitch as a structuring set size (SSS) of a morphology filter performing a morphological operation based on the SSS with respect to the audio signal, extracting peaks from the audio signal, which has been subjected to the morphological operation, by using a peak extraction method, and extracting a remainder signal region from the extracted peaks, identifying whether the remainder signal region corresponds to a true-peaks spectrum and detecting a spectral envelope by performing an interpolation operation on the identified true peaks spectrum.

In accordance with a fourth aspect of the present invention, there is provided a method for estimating spectrum information of an audio signal, using an apparatus for estimating spectrum information of the audio signal based on the second aspect of the present invention, the method including the steps of receiving an audio signal, detecting a pitch of the audio signal; determining a period of the pitch as a structuring set size (SSS) of a morphology filter, performing a morphological operation based on the SSS with respect to the audio signal, extracting peaks from the audio signal, which has been subjected to the morphological operation, by using a peak extraction method, and extracting a remainder signal region from the extracted peaks, selecting a high-order peaks spectrum from the remainder signal region, identifying whether the high-order peaks spectrum corresponds to a true peaks spectrum and detecting spectral envelope information by performing an interpolation operation on the identified true peaks spectrum.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION

Figure 1:
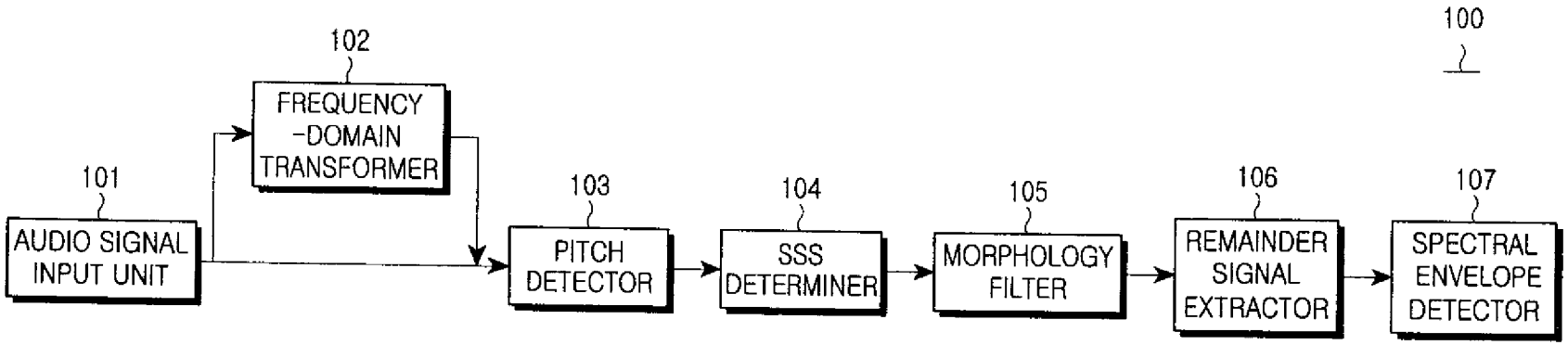
FIG. 1 is a block diagram illustrating the configuration of an apparatus for estimating spectral information of an audio signal according to an exemplary embodiment of the present invention.

Exemplary embodiments of the present invention will be described with reference to the accompanying drawings. The same reference numerals are used to denote the same structural elements throughout the drawings. In the following description of the present invention, the detailed description of known functions and configurations incorporated herein is omitted to avoid making the subject matter of the present invention unclear.

FIG. 1 is a block diagram illustrating the configuration of an apparatus for estimating spectral information of an audio signal according to an exemplary embodiment of the present invention. The audio signal spectrum information estimation apparatus 100 according to an exemplary embodiment of the present invention includes an audio signal input unit 101, a frequency-domain transformer 102, a pitch detector 103, a structuring set size (SSS) determiner 104, a morphology filter 105, a remainder signal extractor 106 and a spectral envelope detector 107.

The audio signal input unit 101 may includes a microphone, or other device to allow the input of an audio signal, and receives an audio signal. The frequency-domain transformer 102 transforms the received audio signal from i a time domain into a frequency domain audio signal. That is, the frequency-domain transformer 102 transforms an audio signal in a time domain into an audio signal in a frequency domain by using a Fast Fourier Transform (FFT). Such a frequency-domain transformer 102 may be selectively included in the audio signal spectrum information estimation apparatus.

In one aspect of the invention, the audio signal may be processed frame by frame.

The morphology filter 105 performs a morphological operation with respect to the waveform of an audio signal in the frequency domain. The morphological operation is a non-linear image processing and analysis method focusing on the geometric structure of an image. Such a morphological operation may be performed by a plurality of linear and non-linear operators, in which the primary operations of dilation and erosion operations and the secondary operations of opening and closing operations are combined.

The morphology filter 105 according to an exemplary embodiment of the present invention performs the dilation, erosion, opening and closing operations with respect to the waveform of a one-dimensional audio signal in the frequency domain, and partially transforms the geometric characteristics of the audio signal waveform.

Since the morphological operation corresponds to a set-theoretical approach method depending on the fitting of the structuring elements to certain specific values, a one-dimensional image-structuring element, such as an audio signal waveform, is represented by a set of discrete values. Here, the structuring set is determined by a sliding window symmetrical to the origin, and the size of the sliding window determines the performance of the morphological operation.

According to an exemplary embodiment of the present invention, the size of the window is defined by the following Equation (1).

$$\text{Window size}=(\text{structuring set size(SSS)}\times 2+1) \quad (1)$$

Accordingly, the size of the window depends on the SSS and, thus, it is possible to control the performance of the morphological operation by adjusting the SSS.

The dilation operation is an operation for determining the maximum value within each predetermined sliding window of an audio signal to a value of the corresponding sliding window. The erosion operation is an operation for determining the minimum value within each predetermined sliding window of an audio signal image to a value of the corresponding sliding window. The opening operation is an operation of performing the dilation operation after the erosion operation, and generates a smoothing effect. The closing operation is an operation of performing the erosion operation after the dilation operation, and generates a filling effect.

The morphology filter 105 can perform the dilation or erosion operation and the opening or closing operation. In the case of the dilation operation, a corresponding sliding window frame is referred to as a dilated region. Also, in the case of the erosion operation, a corresponding sliding window frame is referred to as an eroded region.

The morphology filter 105 outputs a discrete signal waveform in which the dilated or eroded region is discretely shown, resulting from the performing of the dilation or erosion operation and the opening or closing operation.

The SSS determiner 104 determines an SSS for optimizing the performance of the morphology filter 105. The SSS may be determined according to each frame of an audio signal. In a first frame of an audio signal, a pitch period of the audio signal is determined as an initial SSS. Such a pitch of the audio signal is detected by the pitch detector 103 and provided to the SSS determiner 104. In frames subsequent to the first frame of the audio signal, an SSS of a just preceding frame of each frame is determined as an initial SSS for the corresponding frame.

Meanwhile, the SSS determiner 104 changes an initial SSS in order to determine an optimal SSS for the morphology filter 105, if necessary.

The remainder signal extractor 106 extracts a remainder signal characteristic point of each frame from the discrete signal waveform which has been received from the morphology filter 105. According to an exemplary embodiment of the present invention, the remainder signal extractor 106 extracts peaks by using one or more peak extraction methods, such as a hitting peak method, a mid-point method, a pitch-based method, and the like, and extracts a remainder signal region from the extracted peaks.

The hitting peak method is a method for extracting the meeting point of each peak and a dilated region or eroded region, as a peak. The mid-point method is a method for extracting the midpoint of each dilated region or eroded region, as a peak. The pitch-based method is a method for extracting actual peaks which cause dilation or erosion irrespective of sliding window frames. Since the aforementioned peak extraction methods use the fact that the extracted peaks have higher levels than noises, there is a low probability of extracting noise peaks.

The remainder signal extractor 106 extracts a remainder signal region from the extracted peaks. Here, the remainder signal region represents a region excluding stair-case signal portions from peaks that are extracted from an audio signal (closure floor) having been subjected to the closing operation of the morphological operation, by using one method of the aforementioned peak extraction methods.

The remainder signal extractor 106 identifies whether the extracted remainder signal region corresponds to a true peaks spectrum. The true-peaks spectrum does not simply represent a remainder signal region, but rather, it represents a remainder signal region identified for detecting a spectral envelope. Since the true-peaks spectrum is the final spectrum, which has been obtained through a remainder signal region extraction using various peak extraction methods and through an identification process of identifying if the remainder signal region corresponds to a true peaks spectrum, the true peaks spectrum has a state in which noise peaks are removed and much information about the audio signal is included.

According to the present invention, it is identified whether or not a remainder signal region corresponds to a true peaks spectrum by using an SSS based on pitch information. When an initial SSS is determined by using a pitch detected by the pitch detector, it is identified whether or not a remainder signal region obtained through a morphological operation according to the initial SSS corresponds to a true peaks spectrum, as described below.

A method for identifying whether or not a remainder signal region corresponds to a true peaks spectrum is as follows.

1. A true-peaks spectrum includes only one peak within one SSS.

2. A distance between peaks in the true-peaks spectrum is the same as the SSS or has a value within a predetermined acceptable range.

Herein, although the predetermined acceptable range may vary according to the system configurations of an audio signal spectrum information estimation apparatus, it is preferable that the predetermined acceptable range is within 0.1 times the length of an SSS. Accordingly, when the two conditions are satisfied, the remainder signal region corresponds to a true peaks spectrum. However, when the two conditions are not satisfied, the SSS determiner 104 changes the initial SSS so that the two conditions can be satisfied.

In this case, the SSS determiner 104 repeatedly alters the initial SSS until it is determined that a remainder signal region according to the altered SSS corresponds to a true peaks spectrum. Such a repeated SSS alteration excludes remainder signal characteristic points not corresponding to the true peaks spectrum, for example, two or more remainder signal characteristic points existing in one SSS, and a distance between remainder signal characteristic points is neither the same as the SSS nor within the predetermined acceptable range.

Meanwhile, the remainder signal region extracted by the remainder signal extractor 106 is provided to the spectral envelope detector 107.

The spectral envelope detector 107 detects a spectral envelope of an audio signal by performing an interpolation operation on the true peaks spectrum extracted by the remainder signal extractor 106.

Figure 2:
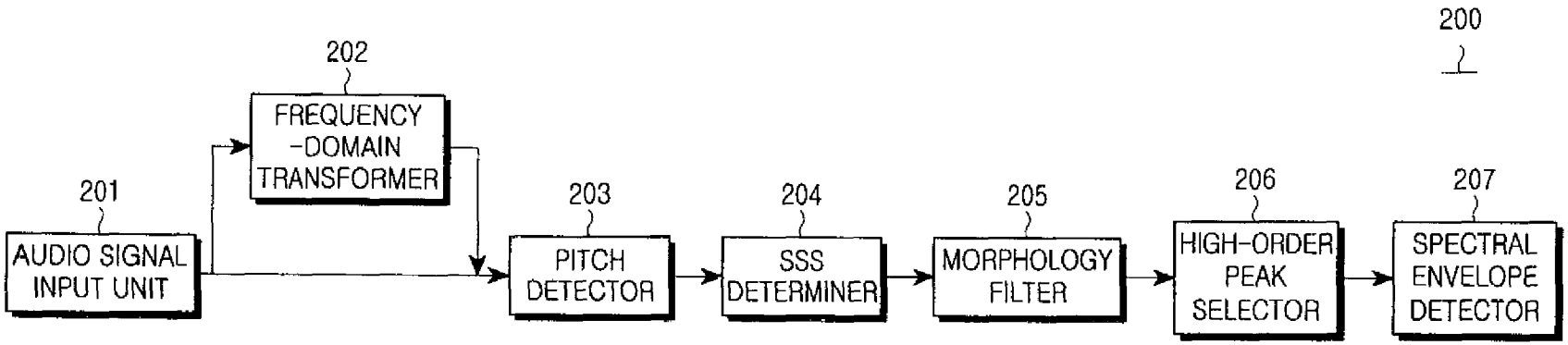
FIG. 2 is a block diagram illustrating the configuration of an apparatus for estimating spectral information of an audio signal according to another exemplary embodiment of the present invention.

FIG. 2 is a block diagram illustrating the configuration of an apparatus for estimating spectral information of an audio signal according to another exemplary embodiment of the present invention. The audio signal spectrum information estimation apparatus 200 according to said other exemplary embodiment of the present invention includes an audio signal input unit 201, a frequency-domain transformer 202, a pitch detector 203, an SSS determiner 204, a morphology filter 205, a remainder signal extractor 206, a high-order peak selector 206 and a spectral envelope detector 207.

The audio signal spectrum information estimation apparatus 200 of FIG. 2 further includes the high-order peak selector 206. The configurations of the audio signal input unit 101, the frequency-domain transformer 102, the pitch detector 103 and the morphology filter 105 in the audio signal spectrum information estimation apparatus 100 shown in FIG. 1 are the same as the audio signal input unit 201, the frequency-domain transformer 202, the pitch detector 203 and the morphology filter 205 in the audio signal spectrum information estimation apparatus 200 shown in FIG. 2, respectively. Accordingly, the description of the same configurations need not be provided in detail again.

The high-order peak selector 206 extracts peaks from an audio signal waveform, which has been subjected to the morphological operation by the morphology filter 205, through the use of a peak extraction method, and extracts a remainder signal region from the extracted peaks. The peak extraction method may be selected from one or more of a hitting peak method, a mid-point method and a pitch-based method, similar to the peak extraction method used in the audio signal spectrum information estimation apparatus 100 of FIG. 1.

The order of each remainder signal characteristic point (i.e., each peak) in the remainder signal region is defined by a theorem on high-order peaks. A high-order peaks spectrum of a predetermined order, which includes the most information about the audio signal and is effective in removing noise peaks, is selected.

The processing on high-order peaks is as follows.

1. Only one valley (or peak) exists between consecutive peaks (or valleys).

2. Rule 1 is applied to the peaks (or valleys) of each order.

3. The number of higher-order peaks (or valleys) is less than that of lower-order peaks (or valleys), and the higher-order peaks (or valleys) exist between the lower-order peaks (or valleys).

4. At least one lower-order peak (or valley) always exists between any two consecutive high-order peaks (or valleys).

5. The high-order peaks (or valleys) have higher (or lower) level amplitudes than the lower-order peaks (or valleys) on the average.

6. During a specific duration (e.g., during a single frame), there exists an order having a single peak and valley (e.g., the maximum value and the minimum value in the single frame).

The high-order peak selector 206 first defines the extracted remainder signal region as a first-order peaks spectrum, and defines higher peaks between the first-order peaks as a second-order peaks spectrum. Additionally, the high-order peak selector 206 defines higher peaks between the defined second-order peaks as a third-order peaks spectrum. Also, high-order valleys spectrums may be defined in the same manner as described above.

Such a high-order peaks spectrum or high-order valleys spectrum may be used as very effective statistical values in extracting the characteristics of audio and sound signals, and particularly the second-order and third-order peaks spectrums among the high-order peaks spectrums have the pitch information of the audio and sound signals. In addition, a time between the second-order peaks and the third-order peaks and the number of sampling points also greatly affect the extraction of information of the audio and sound signals. It is preferable for the high-order peak selector 206 to select the second-order peaks spectrum or the third-order peaks spectrum.

The high-order peak selector 206 selects an order through the use of a ratio "Rn" of the total energy of the selected $n^{th}$ order peaks spectrum to energy of the remainder signal region of the $n^{th}$ order peaks spectrum. The order selection method of the high-order peak selector 206 will be described in the description of an audio signal spectrum information estimation method below.

The high-order peak selector 206 identifies whether or not the high-order peaks spectrum corresponds to a true peaks spectrum. The true peaks spectrum does not simply represent a high-order peaks spectrum, but rather, it represents a high-order peaks spectrum finally identified for detecting spectral envelopes. Since the true peaks spectrum is the final spectrum, which has been obtained through a remainder signal region extraction process using one or more peak extraction methods, an order selection process for the high-order peaks spectrum, and an SSS alteration process described below, the true-peaks spectrum has a state in which noise peaks are removed and much information about the audio signal is included.

According to the present invention, it is identified whether or not a high-order peaks spectrum corresponds to a true peaks spectrum by using an SSS based on pitch information. When an initial SSS has been determined through the use of a pitch detected by the pitch detector, as described above, it is possible to identify whether or not a high-order peaks spectrum corresponds to a true peaks spectrum, as described below.

A method for identifying whether or not a high-order peaks spectrum corresponds to a true peaks spectrum is as follows.

1. A true-peaks spectrum includes only one peak within an SSS.

2. A distance between peaks in the true peaks spectrum is the same as the SSS or has a value within a predetermined acceptable range about the SSS.

Although the predetermined acceptable range may vary depending on the configurations of the audio signal spectrum information estimation apparatus 200, it is preferable that the predetermined acceptable range is within 0.1 times the length of an SSS. Accordingly, when the two conditions are satisfied, the high-order peaks spectrum corresponds to a true peaks spectrum.

However, when the two conditions are not satisfied, the SSS determiner 204 changes the initial SSS so that the two conditions can be satisfied. The SSS determiner 204 repeatedly changes the initial SSS until it is determined that a high-order peaks spectrum according to the changed SSS corresponds to a true peaks spectrum. Such a repeated SSS change excludes high-order peaks not corresponding to the true-peaks spectrum, for example, when two or more high-order peaks exist in one SSS, and a distance between high-order peaks is neither the same as the SSS nor within the predetermined acceptable range.

The SSS determiner 204 determines an SSS for optimizing the performance of the morphology filter 205, in which the SSS may be determined according to each frame of an audio signal. In a first frame of an audio signal, a pitch period of the audio signal is determined as an initial SSS. Such a pitch of the audio signal is detected by the pitch detector 203 and provided to the SSS determiner 204. In frames subsequent to the first frame of the audio signal, an SSS of a just preceding (i.e., a previous) frame is set as an initial SSS for the subsequent or next frame.

Meanwhile, the high-order peaks spectrum finally selected by the high-order peak selector 206 is provided to the spectral envelope detector 207.

The spectral envelope detector 207 performs an interpolation operation on true peaks spectrums of a predetermined order, which has been selected by the high-order peak selector 206, and detects a spectral envelope of an audio signal.

Figure 3:
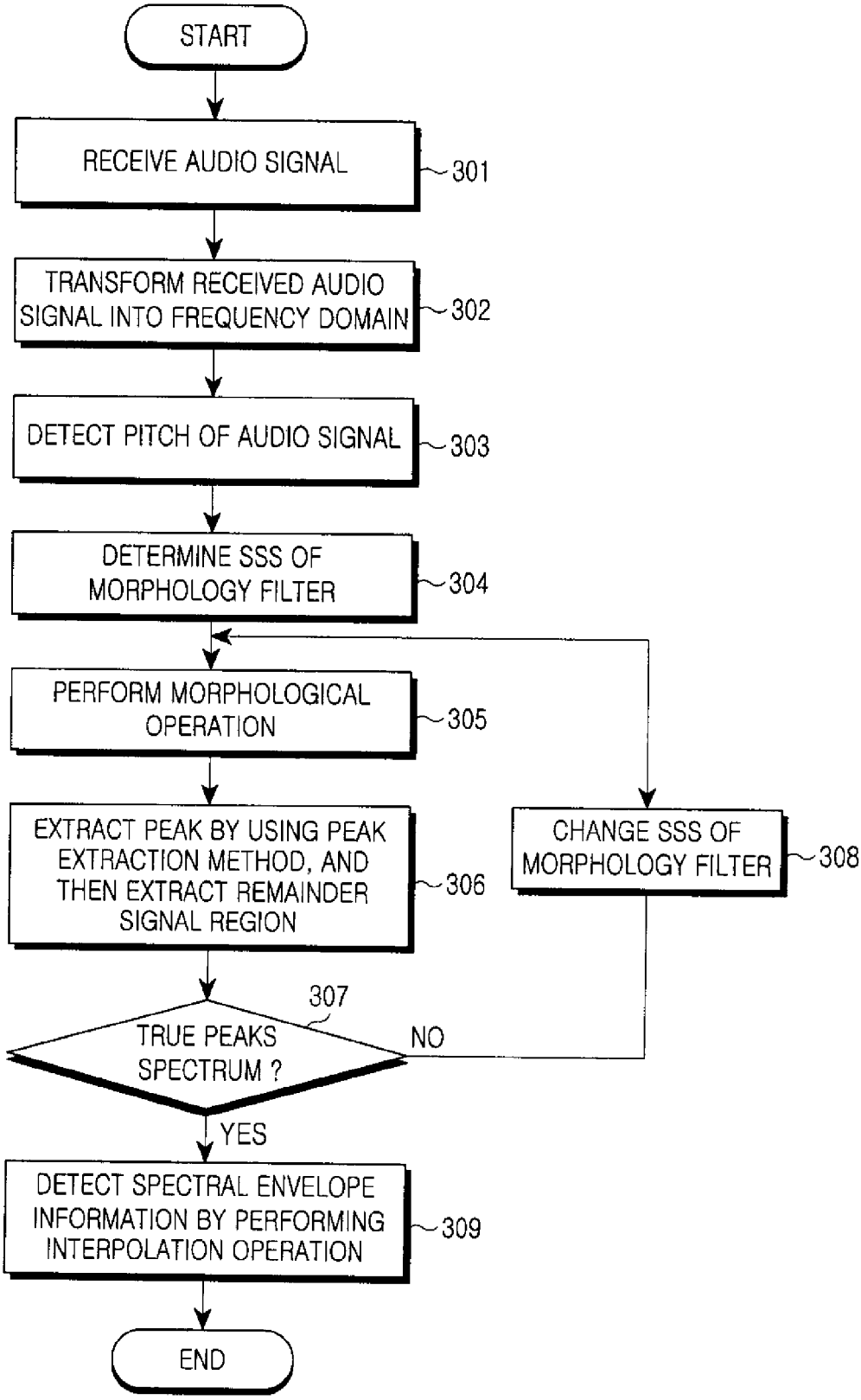
FIG. 3 is a flowchart illustrating a method for estimating spectral information of an audio signal according to an exemplary embodiment of the present invention.

A method for estimating spectral information of an audio signal according to an exemplary embodiment of the present invention is now described with regard to FIG. 3. FIG. 3 is a flowchart illustrating a method for estimating spectral information of an audio signal according to an exemplary embodiment of the present invention. Here, the estimation method is implemented by using the audio signal spectrum information estimation apparatus 100 shown in FIG. 1.

The audio signal input unit 101 receives an audio signal through a microphone or other similar device in step 301. In step 302, the received audio signal, which is in a time domain, is transformed into an audio signal in a frequency domain by using a Fast Fourier Transform (FFT) or other similar type processing (i.e., Fourier Transform). Step 302 may be selectively included in the audio signal spectrum information estimation method. Meanwhile, such an audio signal in the time domain or frequency domain may be processed frame by frame.

After the audio signal in the time domain has been transformed into the audio signal in the frequency domain, the pitch of the received audio signal is detected by using the pitch detector in step 303, and the pitch information is provided to the SSS determiner 104. In step 304, the SSS determiner 104 calculates the period of the pitch and determines the calculated period as an initial SSS for the first frame of the audio signal.

After the initial SSS has been determined, the spectrum information estimation apparatus performs a morphological operation on the audio signal waveform in the frequency domain by using a sliding window according to the initial SSS in step 305. In this case, the dilation, erosion, opening, and/or closing operations may be used as the morphological operation.

Figure 5:
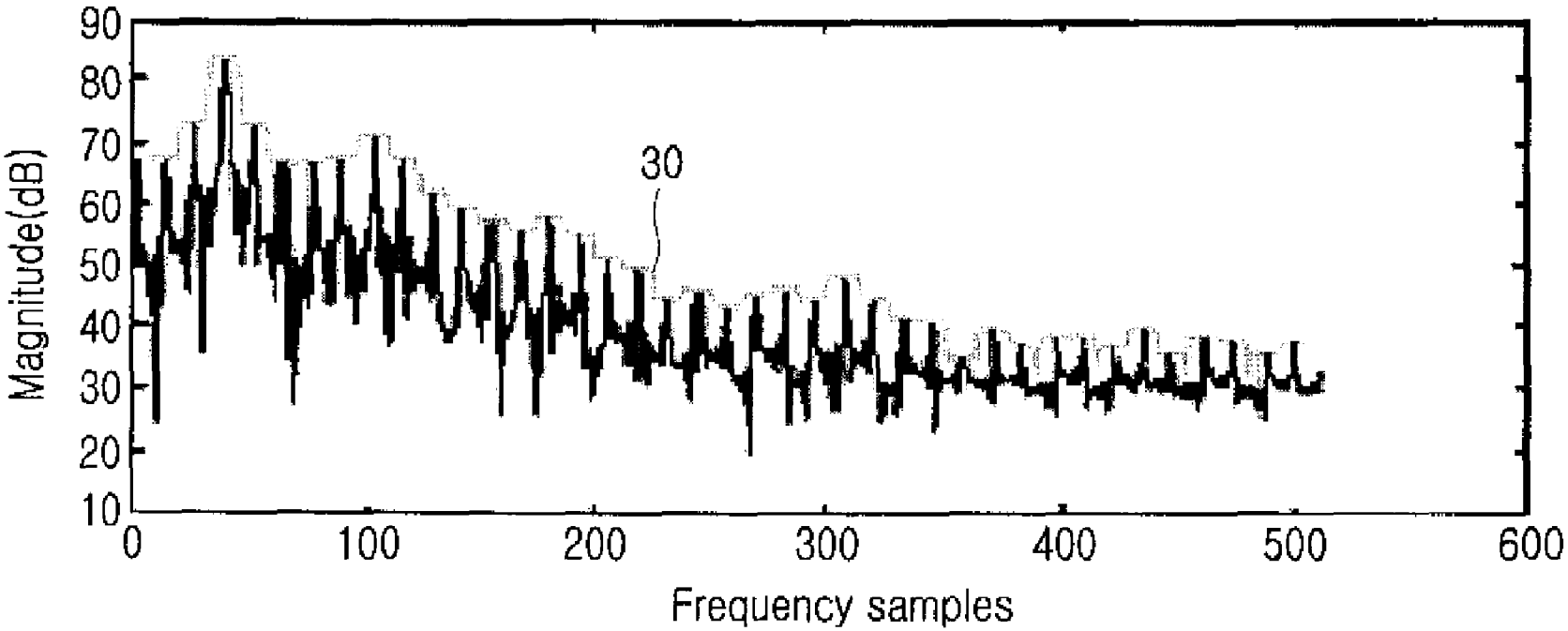
FIG. 5 is a view illustrating a result of a dilation operation of a morphological operation according to an exemplary embodiment of the present invention.

FIG. 5 is a view illustrating a result of the dilation operation according to an exemplary embodiment of the present invention. When the dilation operation is performed, the audio signal spectrum information estimation apparatus determines a maximum value within each predetermined sliding window of the audio signal as a value of the corresponding sliding window frame. Accordingly, when the dilation operation has been performed on an audio signal, a discontinuous discrete signal waveform in which each dilated region has a maximum value of the corresponding sliding window frame is generated, as shown in FIG. 5.

Figure 6:
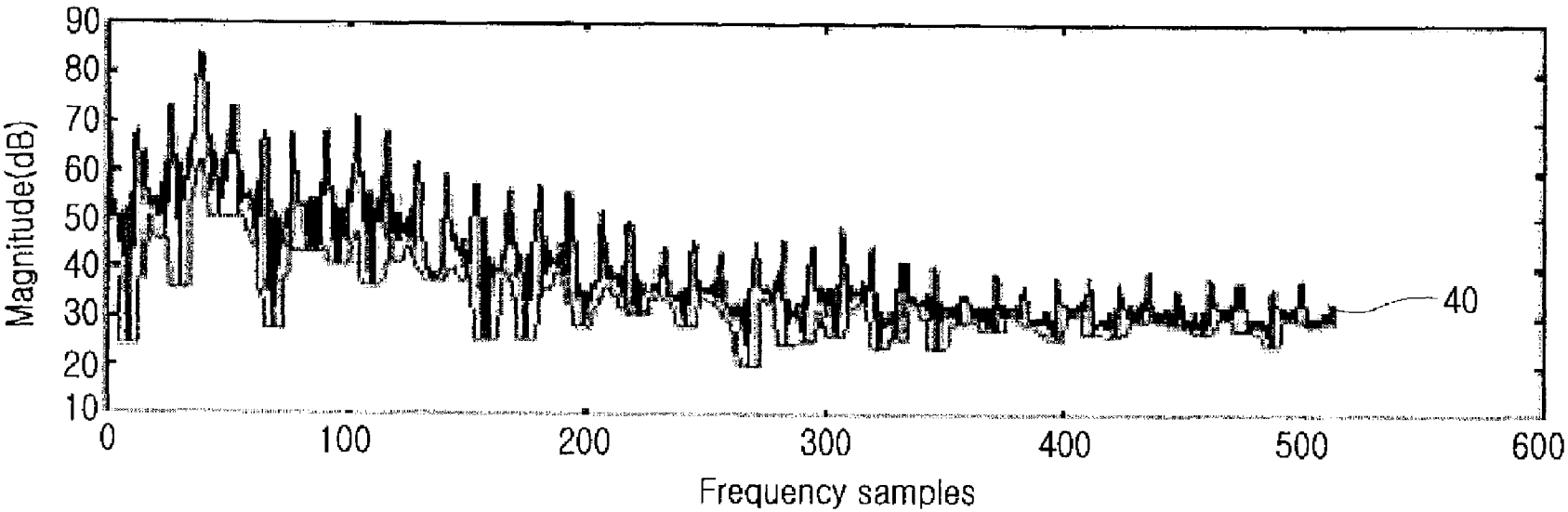
FIG. 6 is a view illustrating a result of an erosion operation of a morphological operation according to an exemplary embodiment of the present invention.

FIG. 6 is a view illustrating a result of the erosion operation according to an exemplary embodiment of the present invention. When the erosion operation is performed, the audio signal spectrum information estimation apparatus determines a minimum value within a sliding window frame (i.e., the SSS period) of an audio signal image as a value of the corresponding sliding window frame. Accordingly, when the erosion operation has been performed on an audio signal waveform, a discontinuous discrete signal waveform image in which each eroded region constantly has a minimum value of the corresponding sliding window frame is generated, as shown in FIG. 6.

Returning to FIG. 3, after the morphological operation has been performed, the remainder signal extractor 106 (FIG. 1) extracts peaks from the audio signal waveform, which has been subjected to the morphological operation, by means of a peak extraction method, and extracts a remainder signal region in step 306. In this case, the remainder signal extractor 106 can extract the peaks by using one or more peak extraction methods selected from a hitting peak method, a mid-point method, and a pitch-based method.

Figure 7:
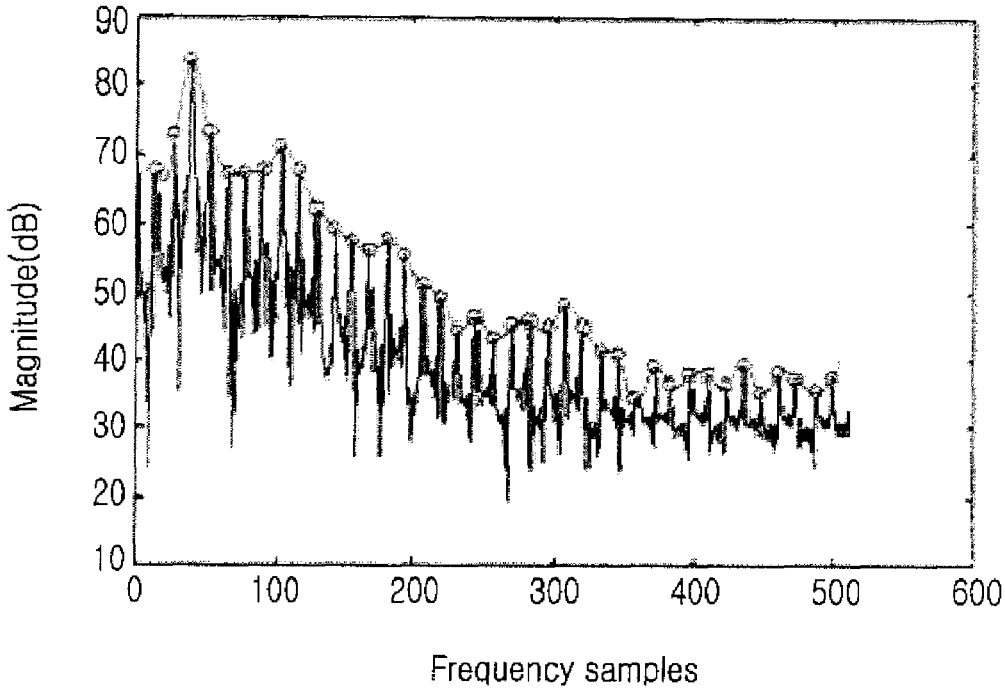
FIG. 7 is a view illustrating an example in which an interpolation operation has been performed on a remainder signal region by applying a hitting peak method according to an exemplary embodiment of the present invention.

The hitting peak method is a method for extracting the meeting point of each peak of the audio signal waveform and a dilated or eroded region, as a remainder signal characteristic point. FIG. 7 is a view illustrating an example in which an interpolation operation has been performed on a remainder signal region by applying the hitting peak method. Circles correspond to remainder signal characteristic points extracted through the hitting peak method. The spectrum information estimation apparatus performs the interpolation operation on the remainder signal characteristic points, thereby detecting spectral envelope information of the audio signal.

Figure 8:
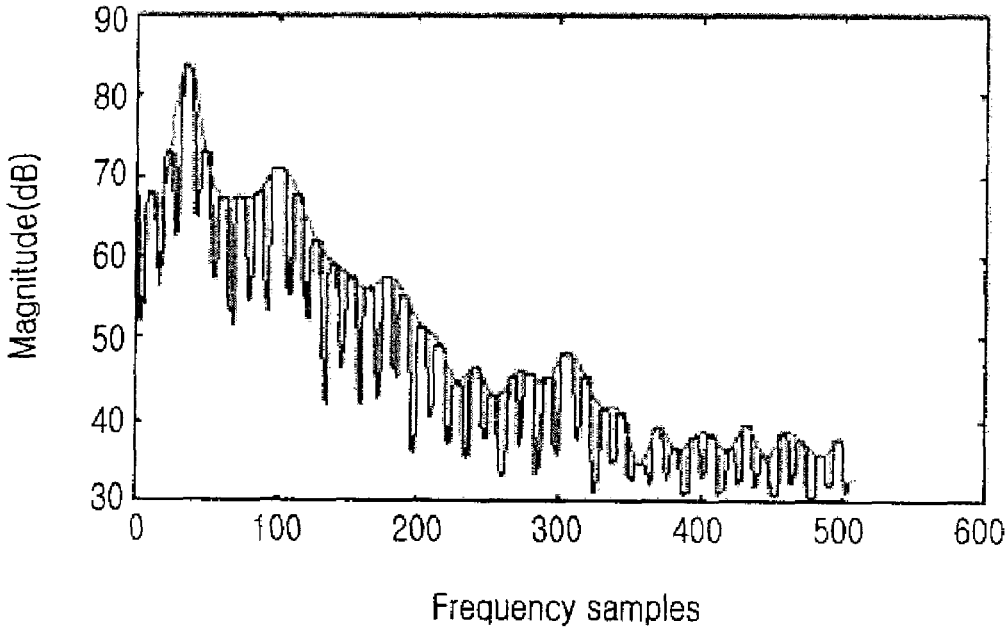
FIG. 8 is a view illustrating an example in which an interpolation operation has been performed on a remainder signal region by applying a mid-point method according to an exemplary embodiment of the present invention.

The mid-point method is a method for extracting the mid-point of each dilated region or eroded region as a peak. FIG. 8 is a view illustrating an example in which an interpolation operation has been performed on a remainder signal region by applying the mid-point method. The spectrum information estimation apparatus performs the interpolation operation on the midpoints of each dilated region or each eroded region, thereby detecting spectral envelope information of the audio signal.

Figure 9:
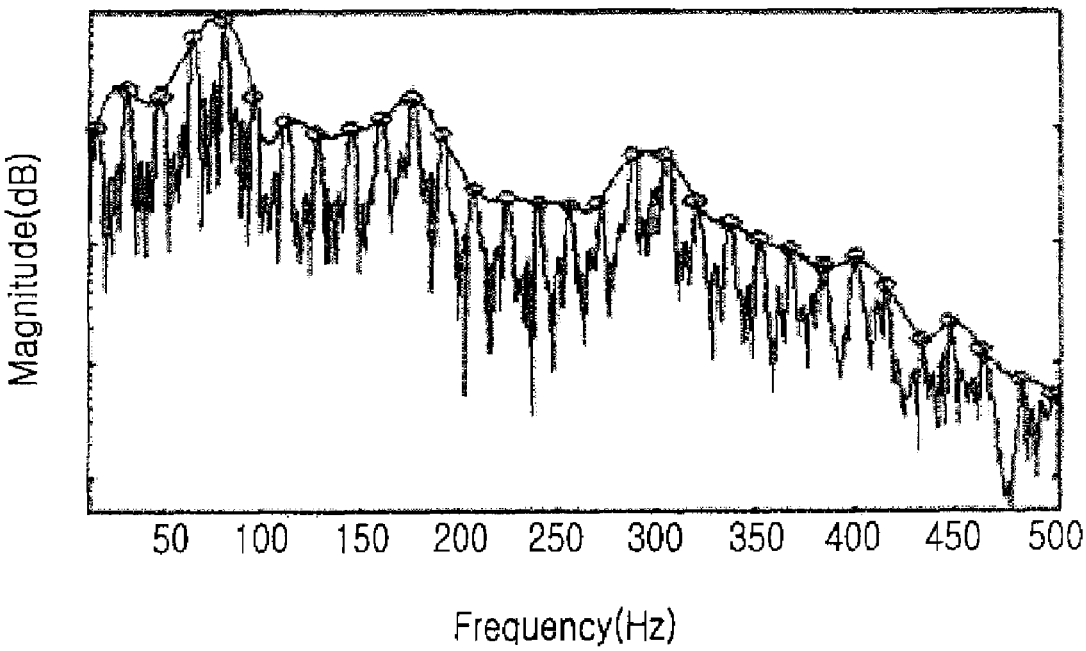
FIG. 9 is a view illustrating an example in which an interpolation operation has been performed on a remainder signal region by applying a pitch-based method according to an exemplary embodiment of the present invention.

The pitch-based method is a method for extracting actual peaks which cause an audio signal waveform to be dilated or eroded irrespective of sliding window frames. FIG. 9 is a view illustrating an example in which an interpolation operation has been performed on a remainder signal region by applying the pitch-based method. Circles correspond to actual peaks extracted through the pitch-based method. The spectrum information estimation apparatus performs the interpolation operation on the extracted actual peaks, thereby detecting spectral envelope information of the audio signal.

The remainder signal extractor 106 extracts a remainder signal region from the extracted peaks. Here, the remainder signal region represents a region, except for a stair-case signal portion, among peaks which are extracted, by using one method among the aforementioned peak extraction methods, from an audio signal (closure floor) which has been subjected to the closing operation of the morphological operation.

Returning to FIG. 3, in step 307, the remainder signal extractor 106 identifies whether or not the remainder signal region corresponds to a true peaks spectrum. As described in the description of the audio signal spectrum information estimation apparatus, the method for identifying whether or not a remainder signal region corresponds to a true peaks spectrum is as follows.

1. A true-peaks spectrum includes only one peak within one SSS.

2. A distance between peaks in the true peaks spectrum is the same as the SSS or has a value within a predetermined acceptable range about the SSS.

Although the predetermined acceptable range may vary depending on the audio signal spectrum information estimation apparatus 100, it is preferable that the acceptable range is within 0.1 times the length of an SSS (i.e., 0.9 SSS-1.1 SSS). When a remainder signal region satisfies the two conditions, the remainder signal region corresponds to a true peaks spectrum. In this case, the spectral envelope detector 107 performs the interpolation operation on the true peaks spectrum and detects a spectral envelope in step 309. However, when the two conditions are not satisfied, the SSS determiner 104 changes the initial SSS so that the two conditions can be satisfied in step 308. In this case, steps 305 to 308 are repeated to change the initial SSS until it is determined that a corresponding remainder signal region corresponds to a true peaks spectrum.

Herein, the SSS change (alteration) method of the morphology filter 105 is as follows.

1. Decreasing the value of an SSS when two or more remainder signal characteristic points exist within one sliding window frame, and increasing the value of an SSS when no remainder signal characteristic point exists within one sliding window frame.

2. Decreasing the value of an SSS when a distance between remainder signal characteristic points is less than the value of the SSS, and increasing the value of an SSS when a distance between remainder signal characteristic points is greater than the value of the SSS.

By using one of the SSS change methods of the morphology filter 105, the SSS determiner 104 can automatically change the value of an SSS. When it is identified that a remainder signal region based on the changed SSS corresponds to a true peaks spectrum, the spectral envelope detector 107 detects a spectral envelope by performing the interpolation operation on the true peaks spectrum in step 309, and then ends the procedure.

According to an embodiment of the present invention, however, since the initial SSS is determined by a morphological operation using pitch information, when the SSS is determined to be too small a value due to a pitch error, the spectral envelope information may be distorted due to too many noise peaks included therein. Meanwhile, when the SSS is determined to be too large a value, the remainder signal characteristic points are missed. Therefore, in order to prevent such a problem, it is necessary to remove incorrectly selected noise peaks before the interpolation operation is performed. To this end, a method for selecting a high-order peaks spectrum may be employed. The step of selecting a high-order peaks spectrum may be selectively included in the audio signal spectrum information estimation method.

Figure 4:
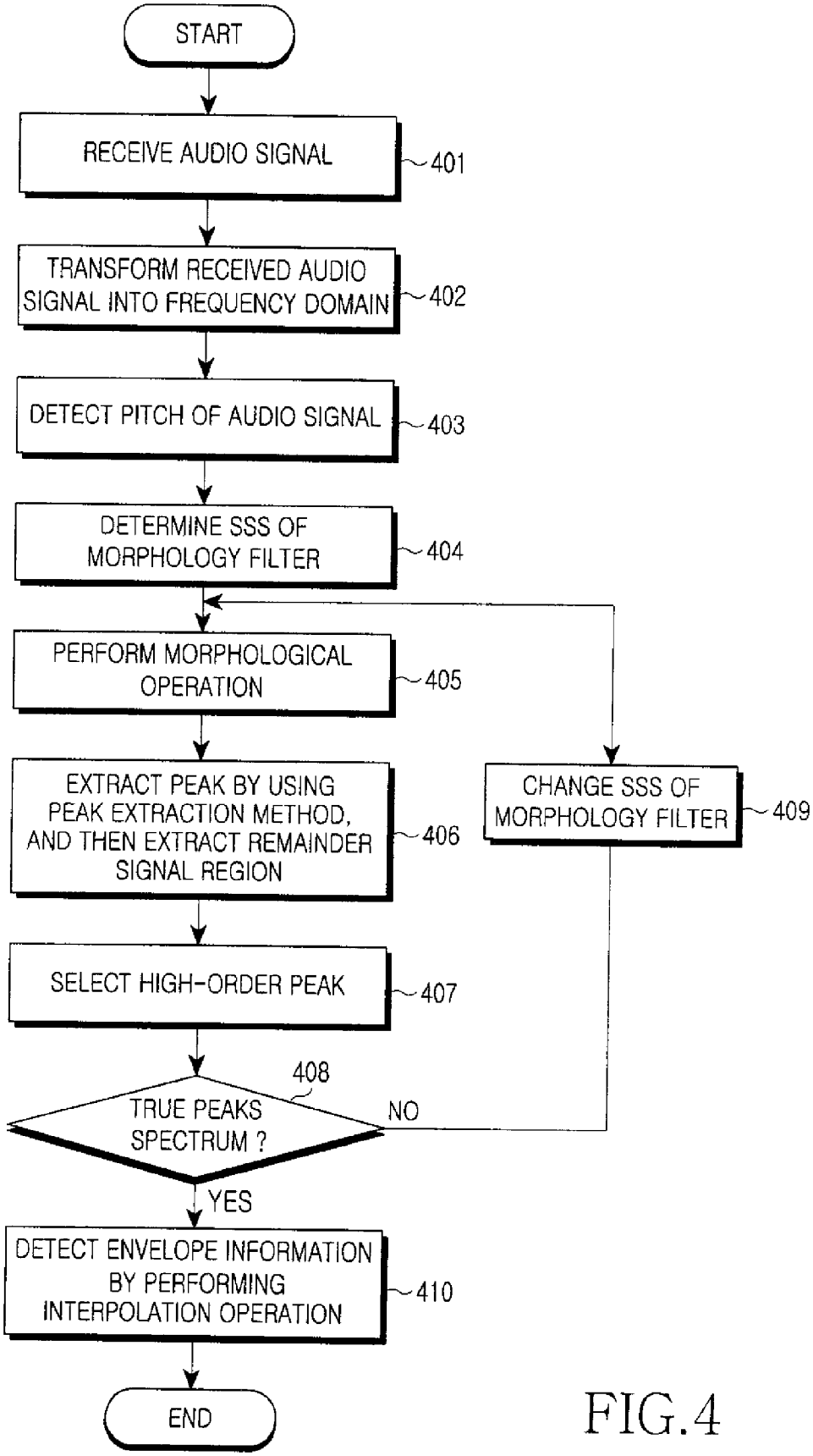
FIG. 4 is a flowchart illustrating a method for estimating spectral information of an audio signal according to another exemplary embodiment of the present invention.

A method for estimating spectrum information of an audio signal according to another exemplary embodiment of the present invention is now described with regard to FIG. 4. FIG. 4 is a flowchart illustrating the method for estimating spectrum information of an audio signal according to said other exemplary embodiment of the present invention. The audio signal spectrum information estimation method is implemented by using the audio signal spectrum information estimation apparatus 200 shown in FIG. 2.

The audio signal spectrum information estimation method according to this second exemplary embodiment of the present invention further includes the steps included in the audio signal spectrum information estimation method described with regard to FIG. 3 and a further step 407 for selecting a high-order peaks spectrum, as will be described below.

Accordingly, the operations of steps 301 to 305 in FIG. 3 are the same as steps 401 to 405 in FIG. 4, respectively and a description of these same operations need not be discussed in detail again.

In step 406, the high-order peak selector 206 extracts peaks from an audio signal waveform, which has been subjected to the morphological operation by the morphology filter 205, through the use of a peak extraction method, and extracts a remainder signal region from the extracted peaks. The peak extraction method may include one or more of a hitting peak method, a mid-point method, and/or a pitch-based method, and is the same as the remainder signal region extraction method described with reference to FIG. 3.

The high-order peak selector 206 selects a high-order peaks spectrum from the remainder signal region in step 407. The high-order peak selector 206 defines an order of each remainder signal characteristic point and selects a high-order peaks spectrum which includes the most information about the audio signal and is suitable for removing noise peaks.

The processing shown selecting a high-order peaks spectrum shown in step 407 is described with reference to FIGS. 10(*a*)-(*c*) through 13.

Figure 10:
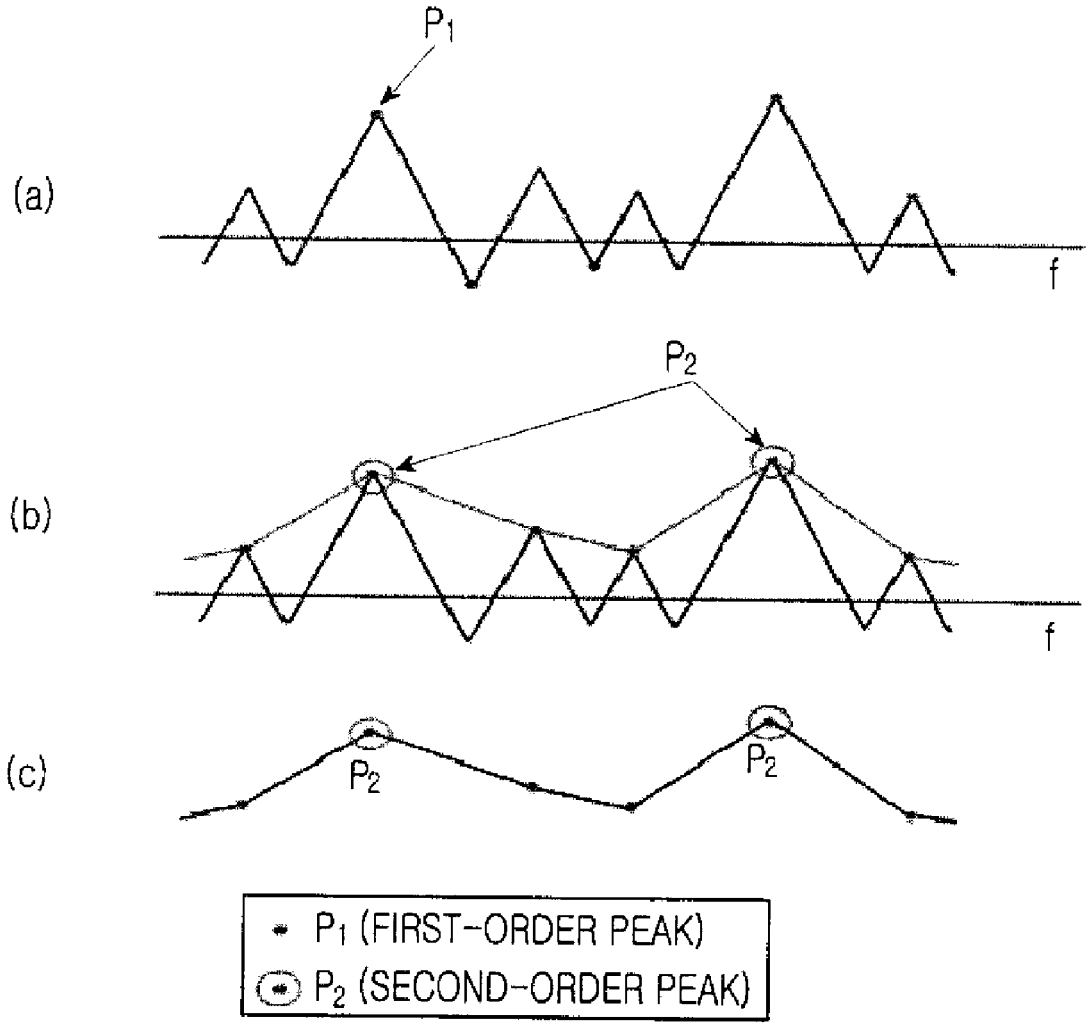
FIGS. 10(*a*) to 10(*c*) are views illustrating a process of defining high-order peaks according to an exemplary embodiment of the present invention.

FIGS. 10(*a*) to 10(*b*) are views illustrating a step of defining high-order peaks according to an exemplary embodiment of the present invention. The audio signal spectrum information estimation apparatus 200 defines remainder signal characteristic points extracted by the high-order peak selector 206 as first-order peaks P1, as shown in FIG. 10(*a*). Then, the spectrum information estimation apparatus 200 detects peaks P2 appearing when the first-order peaks P1 have been connected, as shown in FIG. 10(*b*). The detected peaks P2 are defined as the second-order peaks, as shown in FIG. 10(*c*). Although FIGS. 10(*a*) to 10(*c*) illustrate the defining procedure up to the second-order peaks, the third-order peaks may be defined from the second-order peaks, and thus $n^{th}$ order peaks (wherein, n is a natural number) may be defined in the same manner. In this case, there are many cases where the second-order and third-order peaks among the high-order peaks include much information of the audio and sound signals.

Figure 11:
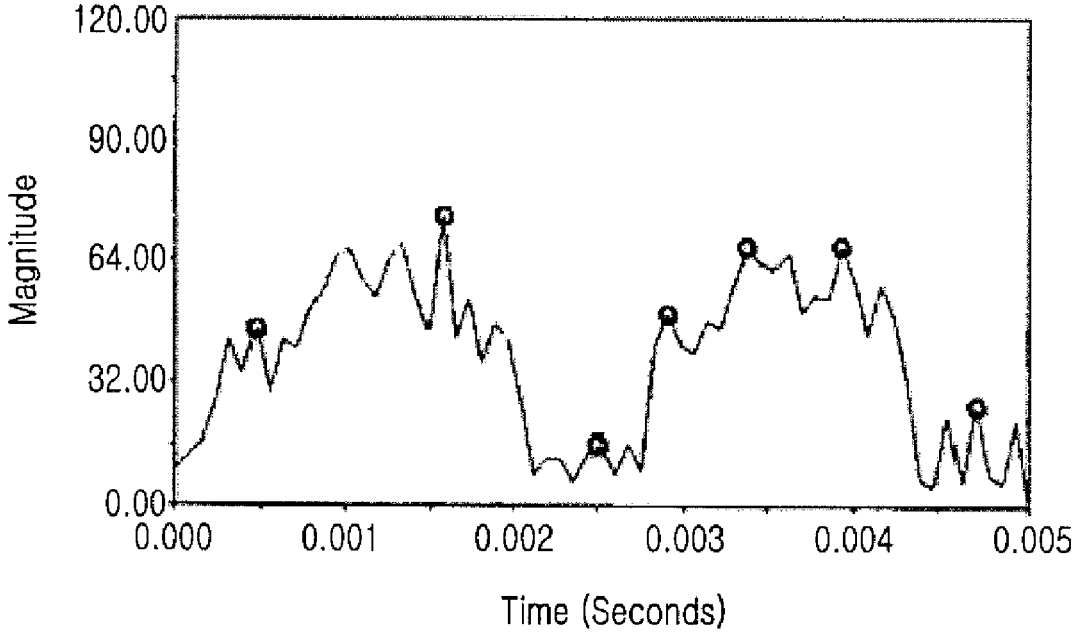
FIG. 11 is a view illustrating a case where the second-order peaks are selected according to an exemplary embodiment of the present invention.

FIG. 11 is a view illustrating a case where the second-order peaks are selected according to an exemplary embodiment of the present invention. FIG. 11 illustrates 200 Hz sinusoidal signals in Gaussian noise, wherein circles represent the selected second-order peaks.

Figure 12:
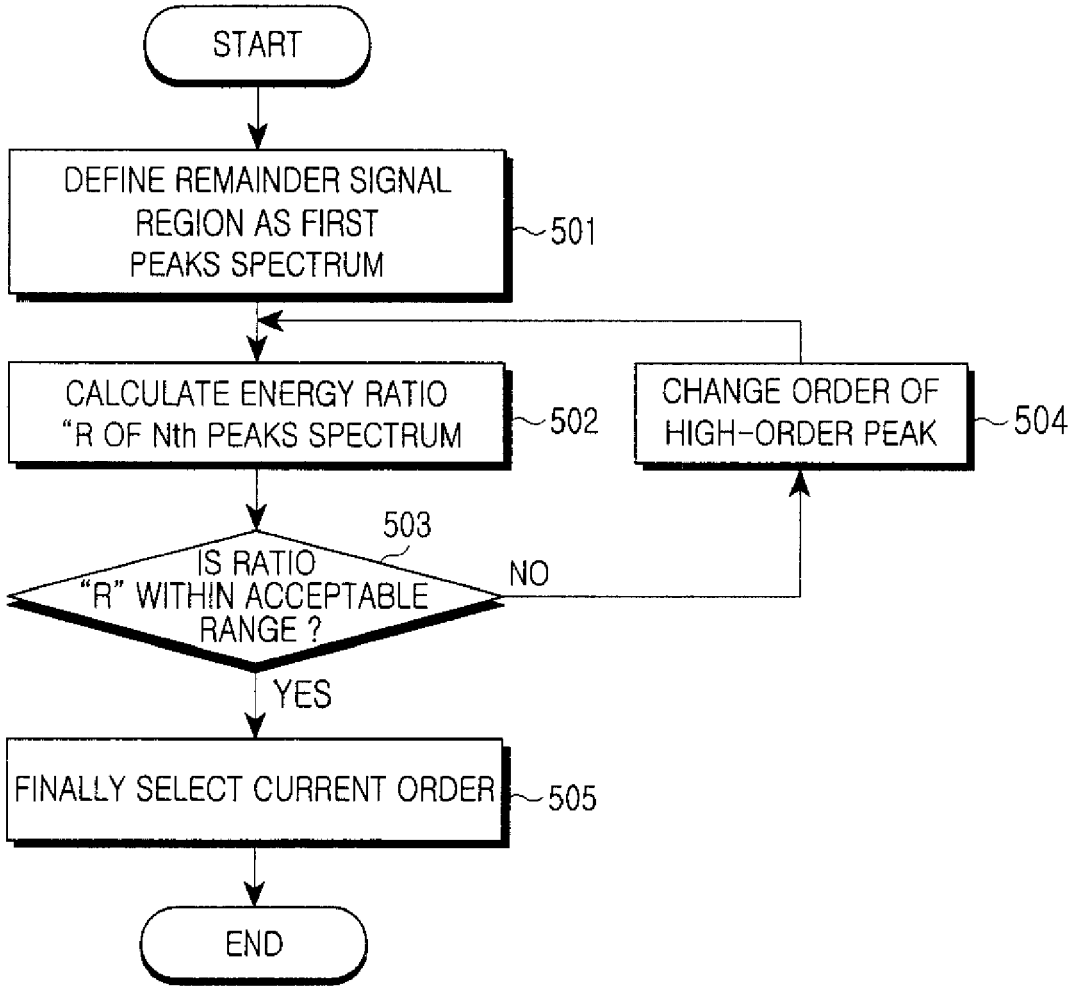
FIG. 12 is a flowchart illustrating a method for selecting an order of high-order peaks according to an exemplary embodiment of the present invention.

FIG. 12 is a flowchart illustrating a method of selecting an order of a high-order peaks spectrum according to an exemplary embodiment of the present invention. In step 501, the high-order peak selector 206 defines remainder signal characteristic points extracted by the high-order peak selector 206 as first-order peaks.

In step 502, the high-order peak selector 206 calculates a ratio "R1" of the total energy of the first-order peaks spectrum to energy of the remainder signal region among the first-order peaks spectrum. Herein, the remainder signal region includes peaks containing the information of the audio signal, and ratio "Rn" is defined by following Equation (2).

$$\text{Ratio}(Rn) = \frac{\text{Total energy of remainder signal region}}{\text{Total energy of } n^{th} \text{ order peaks}} \quad (2)$$

Figure 13:
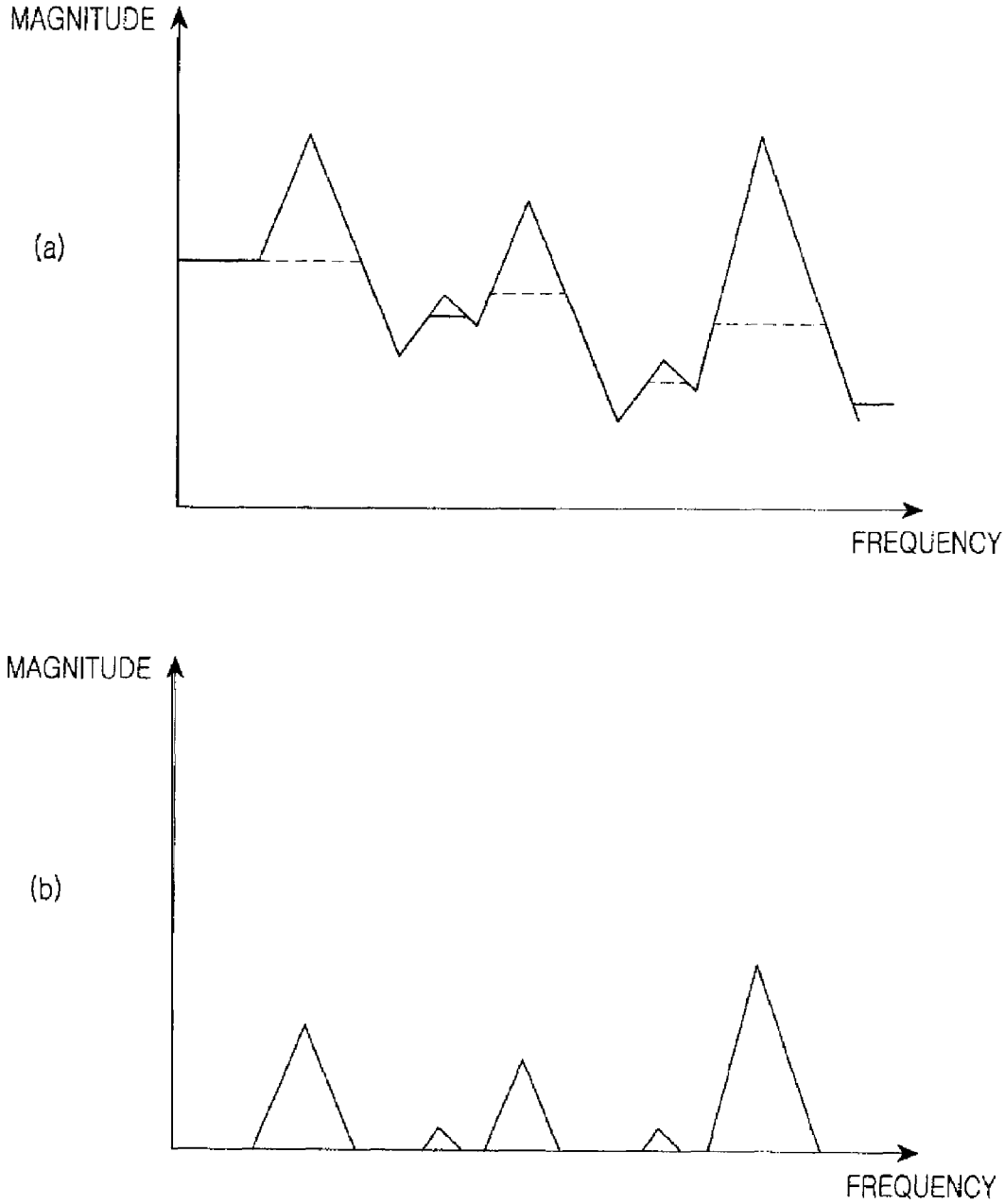
FIGS. 13(*a*) and 13(*b*) are conceptual views illustrating an energy ratio "Rn" of a remainder signal region according to an exemplary embodiment of the present invention.

FIGS. 13(*a*) and 13(*b*) are conceptual views illustrating an energy ratio "Rn" of a remainder signal region of an $n^{th}$ order peaks spectrum according to an exemplary embodiment of the present invention. FIG. 13(*a*) illustrates an audio signal (closure floor) which has been subjected to a morphological operation through a closing operation and has been extracted by a peak extraction method. FIG. 13(*b*) illustrates a spectrum of a remainder signal region obtained by excluding stair-case signals through the closing operation. According to the present invention, a remainder signal region of peaks is extracted differently from the conventional method, in which a ratio similar to the ratio of Equation (2) is calculated using a remainder spectrum constituted with only five to fifteen of the highest peaks. Accordingly, the energy ratio "Rn" of the remainder signal region can be calculated without missing even insignificant information of the audio signal.

In step 503, it is determined whether or not the energy ratio "Rn" of the remainder signal region of the $n^{th}$ order peak to the total energy of the $n^{th}$ order peak has a value within a predetermined acceptable range.

In this case, when the energy ratio "Rn" of the remainder signal region has a value within the acceptable range, the high-order peak selector 206 selects the current order as the final order in step 505. In contrast, when it is determined that the ratio "Rn" has a value outside of the acceptable range, the high-order peak selector 206 changes the order of the high-order peaks spectrum in step 504. In this case, if the ratio "Rn" is above the acceptable range, the high-order peak selector 206 increases the current order by one. In contrast, if the ratio "Rn" is below the acceptable range, the high-order peak selector 206 decreases the current order by one.

In this manner, the high-order peak selector 206 repeatedly performs steps 502 to 504 until the current order of the high-order peaks spectrum has a value within the acceptable range.

Herein, the acceptable range may be a fixed range or may vary. That is, the acceptable range may be determined in such a manner as to lower the acceptable range when a signal-to-noise ratio (SNR) is equal to or greater than a predetermined threshold, and to raise the acceptable range when the SNR is less than the predetermined threshold. Although the case where the SNR is equal to or greater than the predetermined threshold is variable depending on the configuration of the audio signal spectrum information estimation apparatus 200, the case may correspond to a state in which a distortion of an audio signal is reduced or removed, and thus the envelope of the audio signal can be estimated.

Meanwhile, it is preferable that the acceptable range is from 0.2 to 0.4 (i.e., from 20% to 40%) of the total energy.

After selecting a high-order peaks spectrum in step 407, the high-order peak selector 206 identifies whether or not the selected high-order peaks spectrum corresponds to a true peaks spectrum in step 408.

As described in the description of the audio signal spectrum information estimation apparatus, the method for identifying whether or not a high-order peaks spectrum corresponds to a true peaks spectrum is as follows.

1. A true-peaks spectrum includes only one peak within one SSS.

2. A distance between peaks in the true peaks spectrum is the same as the SSS or has a value within a predetermined acceptable range.

Although the predetermined acceptable range may vary depending on the audio signal spectrum information estimation apparatus 200, it is preferable that the predetermined acceptable range is within 0.1 times the length of an SSS (0.9 SSS-1.1 SSS). When a high-order peaks spectrum satisfies the two conditions, the high-order peaks spectrum corresponds to a true peaks spectrum. In this case, the spectral envelope detector 207 performs the interpolation operation on the true peaks spectrum and detects a spectral envelope in step 410 (FIG. 4). However, when the two conditions are not satisfied, the SSS determiner 204 changes the initial SSS so that the two conditions can be satisfied in step 409. In this case, steps 405 to 409 are repeated to change the initial SSS until it is determined that a corresponding high-order peaks spectrum corresponds to a true peaks spectrum.

Herein, the SSS change (alteration) method of the morphology filter 205 is as follows.

1. Decreasing the value of an SSS when two or more high-order peaks exist within one sliding window frame, and increasing the value of an SSS when no high-order peaks exist within one sliding window frame.

2. Decreasing the value of an SSS when a distance between high-order peaks is less than the value of the SSS, and increasing the value of an SSS when a distance between high-order peaks is greater than the value of the SSS.

By using one of the SSS change methods of the morphology filter 205, the SSS determiner 204 can automatically change or alter the value of an SSS. When it is identified that a high-order peaks spectrum based on the changed SSS corresponds to a true peaks spectrum, the spectral envelope detector 207 detects a spectral envelope by performing the interpolation operation on the true peaks spectrum in step 410, and then ends the procedure.

The above-described methods according to the present invention can be realized in hardware or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein.

Meanwhile, the embodiments of the present invention are provided for illustration only, and not for the purpose of limiting the present invention.

As described above, according to the present invention, it is possible to estimate audio signal spectrum information from which noise peaks have been removed. According to the present invention, it is possible to extract a true peaks spectrum, from which noise peaks have been removed, by using the peak information according to the peak extraction method of the present invention. In addition, it is possible to prevent information of audio signals from being lost by using the concept of the energy ratio "Rn" of a remainder signal region in order to select an order of high-order peaks.

Also, according to the present invention, audio signals can be processed more accurately without noise through the change of an SSS by the morphology filter.

Other effects of the present invention will cover a wider range that can be construed not only from the contents described in the aforementioned embodiments and the appended claims of the present invention, but also by the effects which can be generated within a range easily inducible therefrom, and by the probabilities of potential advantages that contribute to the industrial development.

While the invention has been shown and described with reference to specific exemplary embodiments thereof, it will be understood by those skilled in the art that various changes and modifications in form and details may be made therein without departing from the spirit and scope of the invention as defined by the appended claims and equivalents thereto.

What is claimed is:

1. An apparatus for estimating spectrum information of an audio signal, the apparatus comprising:

an audio signal input unit receiving an audio signal; and a processor comprising:

a pitch detector module detecting a pitch of the audio signal received through the audio signal input unit and providing the pitch to a structuring set size (SSS) determiner module;

said (SSS) determiner module determining a period of the pitch as an SSS and providing the SSS to a morphology filter module, and said morphology filter module performing an morphological operation on the audio signal in accordance with the provided SSS;

a remainder signal extractor module extracting peaks from the audio signal, which has been subjected to the morphological operation, by using a peak extraction method, extracting a remainder signal region from the extracted peaks, and identifying whether the remainder signal region corresponds to a true-peaks spectrum; and a spectral envelope detector module detecting a spectral envelope by performing an interpolation operation on the identified true peaks spectrum.

2. The apparatus as claimed in claim 1, further comprising:

a frequency-domain transformer module transforming said audio signal in a time domain, which has been received through the audio signal input unit, into an audio signal in a frequency domain, and providing the transformed audio signal to the pitch detector module.

3. The apparatus as claimed in claim 1, wherein the morphological operation includes at least one operation selected from the group consisting of: a dilation operation, an erosion operation, an opening operation, and a closing operation.

4. The apparatus as claimed in claim 1, wherein the peak extraction method is selected from the group consisting of: a hitting peak method, a mid-point method, and a pitch-based method.

5. The apparatus as claimed in claim 4, wherein the hitting peak method represents extracting a point where each peak of the audio signal, which has been subjected to the morphological operation, meets a dilated region or eroded region, as a remainder signal characteristic point of each sliding window frame.

6. The apparatus as claimed in claim 4, wherein the mid-point method represents extracting a midpoint of a dilated region or eroded region of each sliding window frame from the audio signal, which has been subjected to the morphological operation, as a remainder signal characteristic point.

7. The apparatus as claimed in claim 4, wherein the pitch-based method represents extracting actual peaks of the audio signal, which cause dilation or erosion irrespective of each sliding window frame, from the audio signal having been subjected to the morphological operation.

8. The apparatus as claimed in claim 3, wherein the remainder signal region corresponds to a region, excluding a staircase signal portion, from the peaks that are extracted from the audio signal having been subjected to the closing operation of the morphological operation, by the peak extraction method.

9. The apparatus as claimed in claim 1, wherein, when there is only one remainder signal characteristic point within each of a plurality of sliding window frames of the remainder signal region, and a distance between remainder signal characteristic points is the same as a current SSS or has a value within an acceptable range, the remainder signal extractor identifies the remainder signal region as the true-peaks spectrum.

10. The apparatus as claimed in claim 1, wherein, when the remainder signal extractor module identifies that the remainder signal region does not correspond to a true peaks spectrum, an operation of changing the SSS by the SSS determiner module is repeated until the remainder signal region is identified as the true-peaks spectrum.

11. The apparatus as claimed in claim 10, wherein the SSS determiner module changes an SSS value to a value less than a current SSS value when at least two remainder signal characteristic points exist within one sliding window frame of the remainder signal region, and changes the SSS value to a value greater than the current SSS value when no remainder signal characteristic points exist.

12. The apparatus as claimed in claim 10, wherein the SSS determiner module changes an SSS value to a value less than a current SSS value when a distance between remainder signal characteristic points in the remainder signal region is less than the current SSS value, and changes the SSS value to a value greater than the current SSS value when a distance between remainder signal characteristic points in the remainder signal region is greater than the current SSS value.

13. An apparatus for estimating spectrum information of an audio signal, the apparatus comprising:

an audio signal input unit receiving an audio signal; and a pitch detector unit detecting a pitch of the audio signal received through the audio signal input unit and providing the pitch to a structuring set size (SSS) determiner unit;

said (SSS) determiner unit determining a period of a pitch as an SSS and providing the SSS to an morphology filter unit;

said morphology filter unit performing an morphological operation on the audio signal and said provided SSS;

a high-order peak selector unit extracting peaks from the audio signal, which has been subjected to the morphological operation, by using a peak extraction method, extracting a remainder signal region from the extracted peaks, selecting a high-order peaks spectrum from the remainder signal region, and identifying whether the high-order peaks spectrum corresponds to a true-peaks spectrum; and a spectral envelope detector unit detecting a spectral envelope by performing an interpolation operation on the identified true peaks spectrum.

14. The apparatus as claimed in claim 13, further comprising:

a frequency-domain transformer unit transforming the received audio signal in a time domain, which has been received through the audio signal input unit, into an audio signal in a frequency domain, and providing the transformed audio signal to the pitch detector unit.

15. The apparatus as claimed in claim 13, wherein the morphological operation includes at least one operation selected from the group consisting of: a dilation operation, an erosion operation, an opening operation, and a closing operation.

16. The apparatus as claimed in claim 13, wherein the peak extraction method is selected from the group consisting of: a hitting peak method, a mid-point method, and a pitch-based method.

17. The apparatus as claimed in claim 16, wherein the hitting peak method represents extracting a point where each peak of the audio signal, which has been subjected to the morphological operation, meets a dilated region or eroded region, as a remainder signal characteristic point of each sliding window frame.

18. The apparatus as claimed in claim 16, wherein the mid-point method represents extracting a midpoint of a dilated region or eroded region of each sliding window frame from the audio signal, which has been subjected to the morphological operation, as a remainder signal characteristic point.

19. The apparatus as claimed in claim 16, wherein the pitch-based method represents extracting actual peaks of the audio signal, which cause dilation or erosion irrespective of sliding window frames, from the audio signal having been subjected to the morphological operation.

20. The apparatus as claimed in claim 13, wherein the remainder signal region corresponds to a region, excluding a stair-case signal portion, from the peaks that are extracted from the audio signal having been subjected to the closing operation of the morphological operation, by the peak extraction method.

21. The apparatus as claimed in claim 13 wherein, when there is only high-order peak within each sliding window frame of the high-order peaks spectrum, and a distance between high-order peaks is the same as a current SSS or has a value within a predetermined acceptable range, the high-order peak selector identifies the high-order peaks spectrum as the true-peaks spectrum.

22. The apparatus as claimed in claim 13, wherein, when the high-order peak selector identifies that the high-order peaks spectrum does not correspond to a true peaks spectrum, an operation of performing the morphological operation based on a changed SSS with respect to the audio signal is repeated until the high-order peaks spectrum is identified as the true-peaks spectrum.

23. The apparatus as claimed in claim 22, wherein the SSS determiner unit changes an SSS value to a value less than a current SSS value when at least two high-order peaks exist within one sliding window frame of the high-order peaks spectrum, and changes an SSS value to a value greater than the current SSS value when no high-order peaks exist.

24. The apparatus as claimed in claim 22, wherein the SSS determiner unit changes an SSS value to a value less than a current SSS value when a distance between high-order peaks in the high-order peaks spectrum is less than the current SSS value, and changes an SSS value to a value greater than the current SSS value when a distance between high-order peaks in the high-order peaks spectrum is greater than the current SSS value.

25. The apparatus as claimed in claim 13, wherein the high-order peak selector unit selects a high-order peaks spectrum in which a ratio "Rn" of total energy of an $n^{th}$ order peaks spectrum to total energy of a remainder signal region of the $n^{th}$ order peaks spectrum has a value within an acceptable range.

26. The apparatus as claimed in claim 25, wherein the acceptable range is determined to be a range lower than a predetermined reference range when a signal-to-noise ratio (SNR) is equal to or greater than a predetermined threshold, and the acceptable range is determined to be a range greater than the predetermined reference range when the SNR is less than the predetermined threshold.

27. A method, operable in a processor, for estimating spectrum information of an audio signal using an apparatus for estimating spectrum information of the audio signal, the method comprising the steps of:

receiving, by an audio signal input unit, an audio signal;

detecting, by a pitch detector module, a pitch of the audio signal;

determining, by a structuring set size (SSS) determiner module, a period of the pitch as a structuring set size (SSS);

performing, by an morphology filter module, an morphological operation based on the SSS with respect to the audio signal;

extracting, by a remainder signal extractor module, peaks from the audio signal, which has been subjected to the morphological operation, by using a peak extraction method, and extracting a remainder signal region from the extracted peaks;

identifying, by the remainder signal extractor module, whether the remainder signal region corresponds to a true peaks spectrum; and detecting, by a spectral envelope detector module, a spectral envelope by performing an interpolation operation on the identified true peaks spectrum.

28. The method as claimed in claim 27, further comprising a step of:

transforming the audio signal from a time domain to a frequency domain, wherein a pitch of the audio signal that has been transformed to the frequency domain is detected in the step of detecting the pitch of the audio signal.

29. The method as claimed in claim 27, wherein the peak extraction method is selected from the group consisting of: a hitting peak method, a mid-point method, and a pitch-based method, wherein the hitting peak method represents extracting a point where each peak of the audio signal, which has been subjected to the morphological operation, meets a dilated region or eroded region, as a peak of each sliding window frame, wherein the mid-point method represents extracting a midpoint of a dilated region or eroded region of each sliding window frame from the audio signal, which has been subjected to the morphological operation, as a peak and wherein the pitch-based method represents extracting actual peaks which cause dilation or erosion irrespective of each sliding window frame, from the audio signal having been subjected to the morphological operation.

30. The method as claimed in claim 29, wherein the remainder signal region corresponds to a region, excluding a stair-case signal portion, from the peaks that are extracted from the audio signal having been subjected to the closing operation of the morphological operation, by the peak extraction method.

31. The method as claimed in claim 27, wherein, in the step of identifying whether the remainder signal region corresponds to a true peaks spectrum, when there is only one remainder signal characteristic point within each sliding window frame of the remainder signal region, and a distance between remainder signal characteristic points is the same as a current SSS or has a value within a predetermined acceptable range, the remainder signal region is identified as the true peaks spectrum.

32. The method as claimed in claim 27, wherein, in the step of identifying whether the remainder signal region corresponds to a true-peaks spectrum, when it is determined that the remainder signal region does not correspond to a true peaks spectrum, further comprising the step of:

changing the SSS is repeated until the remainder signal region is identified as the true peaks spectrum.

33. The method as claimed in claim 32, wherein the SSS value is changed to a value less than a current SSS value when at least two remainder signal characteristic points exist within one sliding window frame of the remainder signal region, and the SSS value is changed to a value greater than the current SSS value when no remainder signal characteristic points exist.

34. The method as claimed in claim 32, wherein the SSS value is changed to a value less than a current SSS value when a distance between remainder signal characteristic points in the remainder signal region is less than the current SSS value, and an SSS value is changed to a value greater than the current SSS value when a distance between remainder signal characteristic points in the remainder signal region is greater than the current SSS value.

35. A method for estimating spectrum information of an audio signal using an apparatus comprising a processor for estimating spectrum information of the audio signal, the method causing the apparatus to execute the steps of:

receiving, by an audio signal input unit, an audio signal;

detecting, by a pitch detector unit, a pitch of the audio signal;

determining, by a structuring set size (SSS) determiner unit, a period of the pitch as a structuring set size (SSS);

performing, by an morphology filter unit, an morphological operation based on the SSS with respect to the audio signal;

extracting, by a high-order peak selector unit, peaks from the audio signal, which has been subjected to the morphological operation, by using a peak extraction method, and extracting a remainder signal region from the extracted peaks;

selecting, by the high-order peak selector unit, a high-order peaks spectrum from the remainder signal region;

identifying, by the high-order peak selector unit, whether the high-order peaks spectrum corresponds to a true peaks spectrum; and detecting, by a spectral envelope detector unit, spectral envelope information by performing an interpolation operation on the identified true peaks spectrum.

36. The method as claimed in claim 35, further causing the apparatus to execute the step of:

transforming the audio signal from a time domain to a frequency domain, wherein the pitch of the audio signal transformed to the frequency domain is detected in the step of detecting the pitch of the audio signal.

37. The method as claimed in claim 35, wherein, the morphological operation based on the SSS is selected from the group consisting of: a dilation operation, an erosion operation, an opening operation, and a closing operation is performed.

38. The method as claimed in claim 35, wherein the peak extraction method is selected from the group consisting of: a hitting peak method, a mid-point method, and a pitch-based method.

* * * * *

UNITED STATES PATENT AND TRADEMARK OFFICE

CERTIFICATE OF CORRECTION

PATENT NO. : 8,249,863 B2
APPLICATION NO. : 11/955483
DATED : August 21, 2012
INVENTOR(S) : Hyun-Soo Kim It is certified that error appears in the above-identified patent and that said Letters Patent is hereby corrected as shown below:

In the Claims

Column 14, Claim 1, Lines 22-23 should read as follows:
--...module performing a morphological operation...--

Column 15, Claim 13, Line 39 should read as follows:
--...to a morphology filter...--

Column 15, Claim 13, Lines 41-42 should read as follows:
--...performing a morphological operation...--

Column 16, Claim 18, Line 12 should read as follows:
--...extracting a mid-point of a...--

Column 17, Claim 27, Lines 11-12 should read as follows:
--...by a morphology filter module, a morphological operation...--

Column 18, Claim 32, Line 3 should read as follows:
--...to a true peaks spectrum...--

Column 18, Claim 35, Lines 32-33 should read as follows:
--...by a morphology filter unit, a morphological operation...--

Signed and Sealed this
Twenty-third Day of April, 2013

Teresa Stanek Rea
*Acting Director of the United States Patent and Trademark Office*